United States Patent [19]

Akers et al.

[11] 4,144,913

[45] Mar. 20, 1979

[54] HOT MELT ADHESIVE DISPENSING SYSTEM OF THE HAND HELD GUN TYPE

[75] Inventors: Larry D. Akers; Charles H. Scholl, both of Vermilion; Joseph S. Smith, Euclid; Edward A. Williams, Elyria, all of Ohio

[73] Assignee: Nordson Corporation, Amherst, Ohio

[21] Appl. No.: 762,530

[22] Filed: Jan. 26, 1977

[51] Int. Cl.[2] ..... B65B 3/10

[52] U.S. Cl. ..... 141/2; 141/18; 141/351; 222/146 HE

[58] Field of Search ..... 141/1, 2, 18, 311, 324, 141/346–351, 367, 383, 386, 392; 137/540, 543.15; 222/146 HE, 496; 128/218 P

[56] References Cited

U.S. PATENT DOCUMENTS

| | | | |
|---|---|---|---|
| 3,351,105 | 11/1967 | Di Perna | 141/18 |
| 3,587,930 | 6/1971 | Schultz | 222/146 HE |
| 3,954,206 | 5/1976 | Salonen | 222/146 HE |

*Primary Examiner*—Richard E. Aegerter
*Assistant Examiner*—Frederick R. Schmidt
*Attorney, Agent, or Firm*—Wood, Herron & Evans

[57] ABSTRACT

A hot melt adhesive dispensing system that includes a hand held gun and a molten adhesive source, the gun and the source being selectively connectable one with the other in a novel manner to permit charging and recharging of the gun with molten adhesive from the molten adhesive source. The hand gun includes novel charge valve structure adapted to interconnect with novel feed valve structure mounted on the hot melt adhesive source so as to accomplish transfer of a hot melt adhesive charge in molten form, from the source to the gun storage chamber. The adhesive is pressurized within the gun's storage chamber by a novel pressure device at least partially incorporated within the storage chamber, thereby providing the motive force to cause discharge of molten adhesive from the gun's nozzle in response to manual activation of the gun's trigger.

16 Claims, 7 Drawing Figures

HOT MELT ADHESIVE DISPENSING SYSTEM OF THE HAND HELD GUN TYPE

This invention relates to a hot melt adhesive dispensing system. More particularly, this invention relates to a hot melt adhesive dispensing system of the type that includes an applicator generally configured in the form of, and used as, a hand gun.

Hot melt adhesives, which are usually adhesives of the thermoplastic type, have recently become quite commonplace in certain industries. For example, hot melt adhesives are widely used in the assembly and manufacture of automobiles, furniture, aircraft subassemblies, and the like. Of course, assembly operations in these industries utilize production line techniques, and in that type of assembly where the adhesive applicator cannot remain stationary, i.e., where the operator must have freedom to move the applicator in and out or back and forth as required, a hand gun type of adhesive applicator device is used. However, efficiency on the part of the operator utilizing the hot melt adhesive hand gun is highly desirable. It is important, therefore, that the hand gun be easy to use by the operator without unduly tiring the operator over a regular work day.

A hand-held adhesive applicator device is generally referred to as a gun because of its overall similarity to a hand gun in both configuration and operation. Each such gun is generally provided with a pistol grip or handle portion, a generally barrel-shaped portion that houses the discharge valve for the hot melt adhesive, and a trigger device by means of which operation of the gun is controlled, i.e., by means of which molten adhesive discharge is controlled.

It is highly desirable that a hand-held adhesive gun provide total freedom of movement to its operator in production line or any other type assembly situations. The operator should be able to orient the gun, and therefore the gun's nozzle into any spatial location desired so as to deposit molten adhesive in the exact location required on an assembly or sub-assembly to accomplish the desired bonding resulting in the easiest and most efficient manner. Therefore, and in the most preferred situation, an adhesive gun should be completely portable in the sense that it should not be connected with any feedstock supply source, or any power source, at all; this would allow the operator to manipulate the gun into whatever spatial orientation is desired, no matter what the structural configuration of the workpiece, so as to achieve optimum results. However, and in the case of all hot melt adhesive gun structures known to the art, as far as we are aware, the gun must either be connected to a molten feedstock supply source by a feed hose or to an electric power source by a power cord or to both a feed hose and a power cord so orientation of the gun in that manner desired by the operator is limited to the extent that the gun itself is encumbered by at least one hose or cord. Even with the adhesive gun so connected, it is desirable that the operator have as much freedom and use of the gun as is possible to facilitate production efficiency and to prevent overtiring of the operator. In this connection, the flexibility and weight of a power cord is usually substantially less burdensome than a hot melt feed hose, so that overtiring of the operator when only a power cord is interconnected with a hand gun is not anywhere near as great as when both a power cord and a hot melt feed hose are interconnected with the hand gun.

There are two basic systems for supplying molten adhesive to the discharge valve in a hand gun type applicator device. The first system requires an extruder type structure incorporated in the gun's barrel to translate, within the hand gun itself, solid feedstock (e.g., in pellet or slug form) into molten feedstock at the discharge valve. Such is accomplished by forcing the solid feedstock through a relatively high temperature heat exchanger in the gun's barrel, the force being provided by, e.g., a pneumatic motor supplied with air pressure through a power cord. An adhesive gun of this type is disclosed in U.S. Pat. No. 3,818,930, issued June 25, 1974, and assigned to the assignee of this application.

The second system of supplying molten adhesive feedstock to the gun's discharge valve is to transmit the feedstock in molten form to the gun through a feed hose from a separate supply source. In this system the molten feedstock is translated from solid state (e.g., pellets, bulk, billet or chunk) to molten state at a separate location by a melter structure separate from the hand gun itself. The molten feedstock is then pumped from the melter structure to the hand gun through the gun's molten adhesive feed hose. Adhesive guns adapted to function from an independent molten feedstock supply source in this manner are illustrated in U.S. Pat. No. 3,543,968, issued Dec. 1, 1970, and in U.S. patent application Ser. No. 565,733, filed April 7, 1975 now U.S. Pat. No. 4,006,845, both the patent and the application being assigned to the assignee of this application. Independent supply structures for melting and forwarding molten thermoplastic adhesive material through a feed hose to a separate hand gun structure are illustrated in U.S. Pat. No. 3,815,788, issued June 11, 1974, and U.S. Pat. No. 3,827,603, issued Aug. 6, 1974, both patents being assigned to the assignee of this application.

In high speed assembly or production line situations, it is oftentimes desirable to use that type adhesive gun structure which is supplied with molten feedstock from a totally separate hot melt adhesive source such as described in the second system above. This for the reason that this type system provides a large and continuous supply of molten feedstock to the hand gun and, therefore, to the gun's operator. This precludes the necessity of continuously loading and reloading the gun with solid feedstock by the operator during use, and the attendant time lost in connection therewith, such as required in the first system described above. However, and for hand guns used with the second system, each of these hand guns must be connected directly at all times to the separate molten adhesive source. This connection, as previously mentioned, is maintained through a hot melt feed hose, which may or may not be provided with heater elements along the length thereof.

The necessity of a hot melt feed hose in the second hot melt adhesive dispensing system presents several operating disadvantages, from a practical standpoint, in certain end use situations. First, and from an economic standpoint, each hand gun is generally supplied with its own molten adhesive source. In other words, a separate and individual melter structure remote from the gun is provided for each hand gun because the molten adhesive source must be connected directly at all times with the hand gun through the hot melt feed hose. Second, and from an operating standpoint, the hot melt feed hose itself adds substantial weight to and restraint on the hand-held gun as used or manipulated by the operator. In other words, not only is the hot melt feed hose itself very heavy (relative to an electric cord usually also interconnected with the hand gun for purposes of controlling the temperature of the heater block within the hand gun), but the hot melt feed hose also imposes a substantial restraint on the gun (relative to the electric cord) when the gun must be manipulated into nooks and crannies of a workpiece by an operator. In this latter connection, manipulation of the hand gun into nooks and crannies by the operator, as dictated by the structural characteristics of the workpiece, is impeded by interconnection with the hot melt feed hose and this tends to tire an operator's arm, thereby causing the operator to lose efficiency more quickly than would be the case if no such hot melt feed hose were attached.

Accordingly, it has been one objective of this invention to provide a novel hot melt adhesive dispensing system of the hand-held gun type, that gun carrying one-way charge valve structure adapted to interconnect with feed valve structure mounted on a molten adhesive source for periodically charging and recharging a molten adhesive storage chamber located within the gun's housing, thereby eliminating the necessity of a hot melt feed hose being connected directly with the gun itself during use of the gun, but still providing hot melt adhesive in molten form to the gun.

It has been another objective of this invention to provide a novel hot melt adhesive dispensing system of the hand-held gun type, that system including a molten adhesive source separate from a hand-held adhesive gun adapted to be charged and recharged from that source, that source including novel feed valve structure cooperating with charge valve structure mounted on the adhesive gun, the valve structures cooperating to extend into sealing relationship one with another when said gun is positioned in charging relation with said source.

It has been another objective of this invention to provide a hand-held adhesive gun of the type adapted to discharge a fluid adhesive, that gun incorporating a novel storage chamber structure in which the adhesive is pressurized for discharge, that gun also preferably incorporating a novel charge valve structure by which the storage chamber may be charged and recharged with molten adhesive.

In accord with these objectives, this invention contemplates a hot melt adhesive dispensing system that includes a hand-held gun and a molten adhesive source, the gun and the source being selectively connectable one with the other to permit charging and recharging of the gun with molten adhesive from the molten adhesive source. The hand gun includes charge valve structure adapted to interconnect with feed valve structure mounted on the hot melt adhesive source so as to accomplish transfer of a hot melt adhesive charge in molten form, from the source to the gun's storage chamber. The molten adhesive is pressurized within the gun's storage chamber by a pressure device at least partially incorporated within the storage chamber, thereby providing the motive force to cause discharge of molten adhesive from the gun's nozzle in response to manual activation of the gun's trigger.

Other objectives and advantages of this invention will be more apparent from the following detailed description, taken in conjunction with the drawings, in which.

THE HAND HELD GUN

Figure 2:
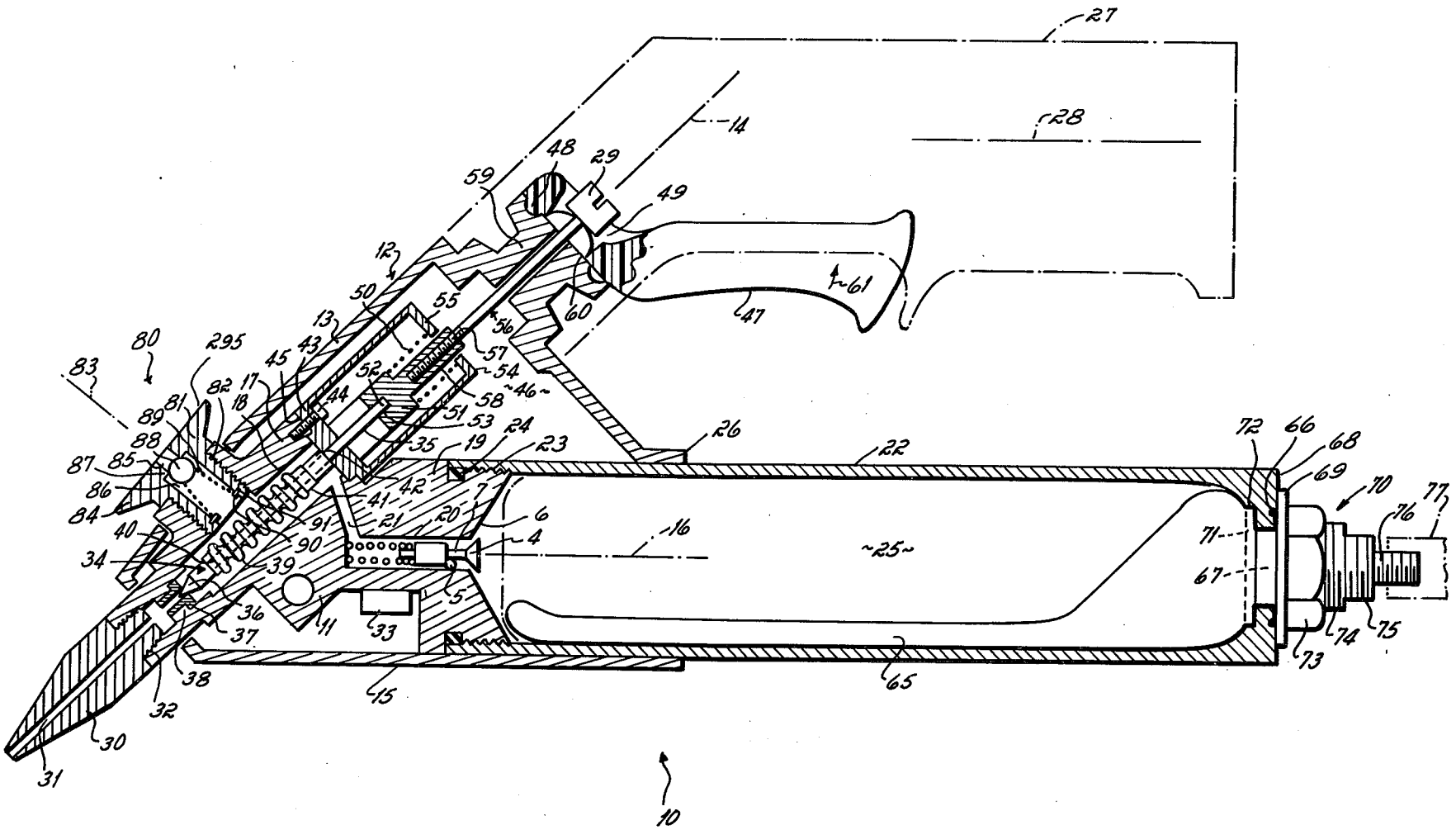
FIG. 2 is a cross-sectional view taken along the center longitudinal plane of a first embodiment of a hand gun structured in accord with the principles of this invention.

A first embodiment 10 of a hand gun is illustrated in FIG. 2. As shown in that Figure, the hand gun 10 includes a heater body 11 disposed within a housing 12. The housing 12 is configured to define a barrel portion 13 having longitudinal axis 14, and a storage chamber 15 portion having longitudinal axis 16, in a vaguely Y-shaped configuration. Likewise, the one-piece heater body 11 includes a barrel portion 17 having bore 18 coaxially disposed with the longitudinal axis 14 of the housing's barrel portion 13, and a feed portion 19 having bore 20 coaxially disposed with the longitudinal axis 16 of the housing's storage chamber portion 15. The heater body's bores 18, 20 are connected by connector bore 21. The storage chamber portion 15 of the housing is in the nature of a tubular shell 22 threadedly received as at 23 to the aft end of heater block 11, an O-ring 24 being interposed between that end of the shell and the heater block to provide a seal tight relation therebetween. The gun's housing 12 is mounted in fixed relation with storage chamber 25 defined by shell 22, and with heater body 11, in an immobile fashion through collar 26 frictionally embracing shell 22 and by other structure, not shown. A handle 27 structure, illustrated in phantom lines, extends rearwardly from the aft end of the housing's barrel portion 13, the handle structure itself forming no part of the structure of this invention. Note particularly that the longitudinal axis 28 of the handle 27 is disposed parallel to the longitudinal axis 16 of the housing's storage chamber 25.

The feed portion 19 of the heater body 11 (which is fabricated of a heat conductive material) defines a bore 18 coaxially aligned with longitudinal axis 14 of the housing's barrel 13 as previously mentioned. This bore 18 is the discharge bore for the molten adhesive. A nozzle 30 with longitudinal bore 31 is threaded, as at 32, into the interior of the discharge bore 18, i.e., into the heater body 11, at the discharge end of the gun 10. The heater body 11 also receives cartridge heaters, not shown, in bores, not shown, in the heater body that are parallel to axis 16 of the heater body. The temperature of the heater body 11 is controlled by thermostat 33 electrically connected to the electrical resistance heater cartridges, not shown, and to a power source, by wires, not shown.

A discharge valve 34 is positioned within the discharge bore 18 interiorly of the heater body 11. The discharge valve 34 includes a valve stem 35 and a valve head 36 fixed thereto, the stem being coaxially disposed within the discharge bore 18. The valve head 36 is adapted to seat against valve seat 37 in sealing fashion, the valve seat being press fit into the bore 18 against shoulder 38. A seal in the nature of a compressible bellows 39 is fixed at one end 40 to the valve stem adjacent the valve head 36 and is fixed at the other end 41 to collar 42 (the valve stem 35 is reciprocable through the collar 42). The collar 42 is held in fixed location within the discharge bore 18 by virtue of being formed integral with retainer plate 43. That retaining plate 43 is bolted by screws 44 to aft end face 45 of the heater body 11. The bellows 39 functions to allow longitudinal movement of the valve stem 35 while maintaining a seal to prevent leakage of molten adhesive feedstock from discharge bore 18 through the aft end 45 of that bore into housing interior 46, thereby allowing valve head 36 and valve seat 37 to function as a discharge valve 34 as permitted by the trigger 47 (described in detail below). The discharge valve 34 assembly is hydraulically unbalanced such that the valve head 36 and stem 35 will move rearwardly due to the hydraulic pressure of molten feedstock in the discharge bore 18 (as viewed in FIG. 2) when the trigger 47 is activated by an operator. This, of course, allows the molten adhesive feedstock to be discharged through the nozzle 30 onto a workpiece.

The gun's trigger 47 is adapted to cooperate with compression spring 50 loaded against a stop 51. End 52 of the valve stem 35 is slidingly received in bore 53 defined by the stop. The trigger 47 functions only to withdraw the stop 51 against the compression spring 50 bias, thereby allowing the discharge valve 34 to open due to hydraulic pressure only of the molten feedstock (as previously described), and slidability of valve stem 35 in the stop's bore 53. The stop 51 is slidingly received in bracket 54, the bracket being formed integral with the retainer plate 43. Compression spring 50 also bears against the underside of that bracket's crown 55. Because of this structure, compression spring 50 forces stop 51 continuously against valve stem 35, thereby continuously biasing the valve head 36 toward the discharge valve 34 closed attitude (shown in FIG. 2) where the valve head is seated on the valve seat 37. An adjusting bolt 56 is threaded, as at 57, into the stop's shaft 58, that adjustment bolt extending through fitting 59 in the aft end of the gun housing's barrel portion 13 into the interior of handle 27. By rotating bolt 56, the compression on spring 50 is increased or decreased as desired, thereby adjusting the finger pressure required to operate the trigger 47.

The trigger 47, which is carried within the gun's handle 27, includes a thumb 48 that defines an elongated slot 49 through which the adjustment screw 56 passes, the adjustment screw's head 29 causing the trigger's thumb 48 to be captured between the screw's head and the lever face 60 at the aft end of fitting 59. When the trigger 47 is pulled upwardly (as shown by directional arrow 61 in FIG. 2) by an operator's index finger, the trigger's thumb 48 bears against lever face 60, thereby causing the stop 51 to be drawn rearwardly against the bias of the compression spring 50 so that the discharge valve 34 can open in response to the hydraulic pressure of the molten feedstock in discharge bore 18. When the operator releases the trigger 47, compression spring 50 moves the stop 51 into abutting contact with the valve stem's end 52, thereby closing the discharge valve 34 since the compression spring pressure overcomes the molten feedstock's hydraulic pressure.

Figure 1:
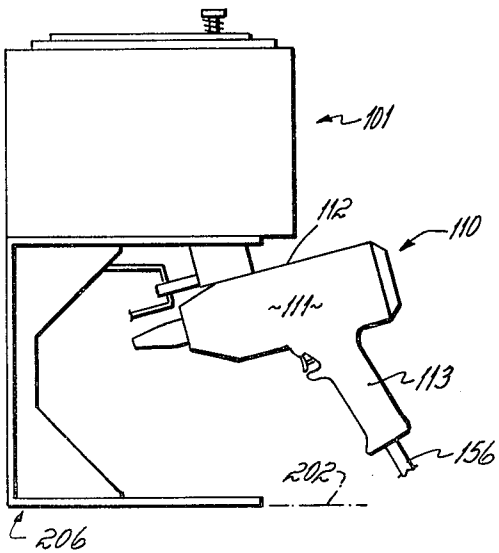
FIG. 1 illustrates a hot melt adhesive dispensing system of the hand-held gun type in accord with the principles of this invention.

The molten adhesive storage chamber 25 is provided with a pressurizing device therein, that device being in the form of a collapsible bladder 65. The bladder 65 is in the nature of a balloon positioned within the storage chamber 25, the collar 66 of the balloon extending out through port 67 at the end of the chamber, and being restrained against the exterior end face 68 of that chamber by washer 69. Threaded fitting 70 is also located in the port 67, that fitting's flange 71 being seated in recess 72 defined in the interior end face of the chamber end. Nut 73 cooperates with threaded section 74 of the fitting 70 to mount that fitting to the chamber's shell 22 and, also, to restrain the bladder 65 in place within the chamber 25. Threaded sections 75, 76 of fitting 70 are adapted to interconnect with a compressed air hose 77, as illustrated in FIG. 1, for providing connection with a compressed air source, not shown, to the interior of the bladder 65. The bladder 65, in response to the compressed air, is adapted to move between a fully collapsed attitude illustrated in solid lines in FIG. 2 and a fully extended position illustrated by phantom lines in FIG. 2, the molten adhesive within the storage chamber 25 being pressurized at the pressure of the compressed air within the bladder 65 so as to provide the motive force for discharging adhesive through the gun's nozzle 30 in response to opening of the discharge valve 34, as operated by the trigger 47 and as previously described. Pressure of the compressed air within bladder 65 remains constant at the air line 77 pressure no matter how much or how little molten adhesive is in storage chamber 25 since the bladder 65 is continuously open to that air line 77. On/off control of compressed air through hose 77 into bladder 65 is at a remote location, not shown.

A normally open spring loaded check valve element is slidlingly disposed in bore 20 of barrel portion 19. Valve 4 element is retained in bore 20 by a lock pin 5 which is forced into an intersecting bore which is at a right angle to bore 20.

Valve 4 has a conical head which cooperates with the tapered end wall 6 of barrel portion 19 to form a valve.

Valve 4 also has a reduced diameter portion or undercut 7 which mechanically cooperates with lock pin 5 to permit limited axial movement of valve element 4 but still retained in bore 20. A compression spring is disposed in one end of bore 20 and engages the tail end of valve 4 and urges valve 4 to the right against lock pin 5 and to an open position.

The function of valve element 4 is to prevent the bladder 65 from being extruded into bore 20 as adhesive is forced from chamber 25 by the bladder 65.

A charge valve 80 is connected with bore 18 of the heater body 11 downstream of the discharge valve's valve head 36/valve seat 37. The charge valve 80 functions to interconnect hand gun 10 with a molten adhesive source 100, described in detail below, for purposes of charging the storage chamber 25 with molten adhesive in a manner described in detail below. The charge valve 80 incorporates a cylindrical valve body 81 threadedly connected with heater body 11 as at 82, the body defining axis 83 that is disposed substantially normal to the longitudinal bore 14 of the bore 18. A port 85 is provided centrally of the valve body 81, that port opening into valve bore 86 defined by the valve body 81. The port 85 and valve bore 86 cooperate to define valve seat 87. The charge valve's seat 87 is adapted to receive a ball 88 valve element in seated relation thereon, the ball being spring closed at all times by compression spring 89. The charge valve's compression spring 89 is maintained in compressive relation with the ball 88 valve element by spring retainer clip 90 which seats in groove 91 defined in the interior surface of the valve bore 86. The charge valve 80, as is apparent from its structure, is a one-way valve in the sense that it can only be opened to receive molten adhesive flow into the heater body's bores 18, 21, 20 from exterior of the gun 10. In other words, molten adhesive flow from the heater body's bore 18 out through port 85 of the charge valve 80 is not possible as any pressure exerted on the ball 88 valve element from the interior of heater block's bore 18 simply serves to further press or force the ball 88 valve element against the valve seat 87. Conversely, and as is explained in greater detail below, the molten adhesive charged into the gun's storage chamber 25 from the molten adhesive source 100 flows first through the charge valve 80 into valve bore 86, then into discharge bore 18 of the heater body 11, thereafter through connector bore 21 and bore 20 in the heater body, and finally into the storage chamber 25 itself. Charging flow of the molten adhesive into storage chamber 25 collapses the bladder 65 into the solid line or substantially fully charged attitude illustrated in FIG. 2. The charge valve's body 81 also mounts a dovetailed adapter 84 on the exterior end face thereof, port 85 opening through the adapter 84. The dovetailed adapter 84 is in the nature of a connector which permits the gun 10 to be interconnected with the molten adhesive source 100 for charging the gun's storage chamber 25, as referred to above and described in detail below.

In use, and once the gun's storage chamber 25 has been fully charged with molten adhesive, high pressure air is introduced into the bladder 65 through air fitting 70 and supply hose 77. Thereafter, and when the gun's trigger 47 is activated by an operator, the discharge valve 34 operates as earlier described to permit molten adhesive to be discharged from the gun's nozzle 30. The pressure within the bladder 65 remains substantially constant no matter what the spatial attitude of the bladder within the storage chamber 25, i.e., no matter how much molten hot melt adhesive remains in or has been discharged from the storage chamber. The compressed air source remains at constant pressure, and that source is continuously and directly connected with the bladder 65. Thus, even pressure is maintained on the molten hot melt adhesive within the storage chamber 25 so as to force the adhesive out of the gun 10 at an even rate no matter what quantum of molten adhesive remains within that chamber until the last of the molten adhesive has been discharged.

Figure 3:
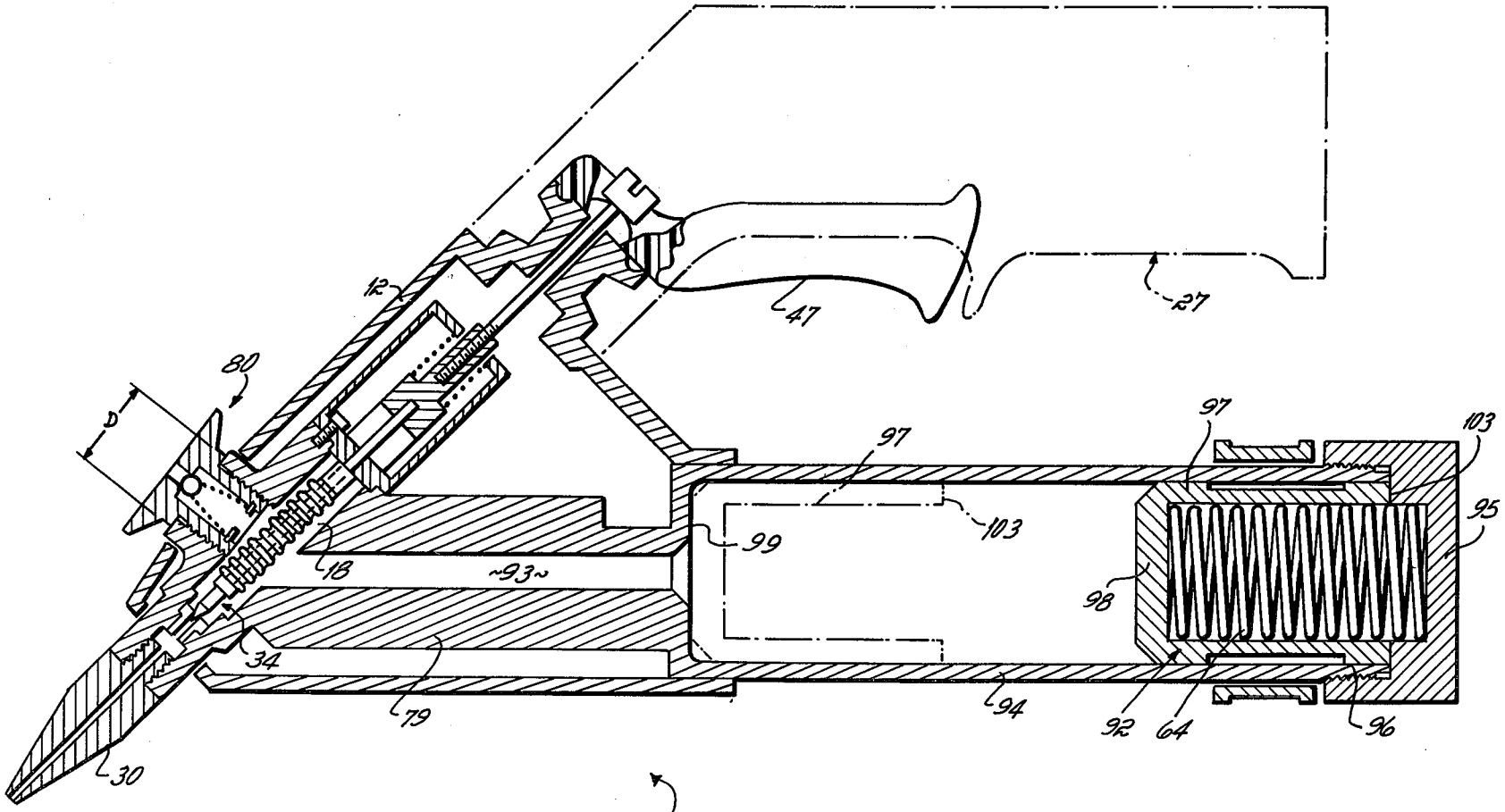
FIG. 3 is a cross-sectional view taken along the center longitudinal plane of a second embodiment of a hand gun also structured in accord with the principles of this invention.

A second embodiment 78 of the hand held adhesive gun, also in accord with the principles of this invention, is illustrated in FIG. 3. The reference numbers used in FIG. 3 are identical to those used in FIG. 2 for identical parts. The primary differences between the FIG. 3 embodiment and the FIG. 2 embodiment, previously described, is in the structure of heat block 79 and the pressurizing device 92. In other words, the FIG. 3 hand gun 78 structure incorporates the same housing 12 structure, the same discharge valve 34 structure, the same handle 27 structure, the same nozzle 30 structure, and the same charge valve 80 structure as with the FIG. 2 embodiment.

In the second hand gun embodiment 78, the heater block 79 is of a slightly different structural configuration than that shown for the heater block 11 in the FIG. 2 embodiment. However, and as with heater block 11, the heater body 79 also has at least one heater cartridge, not shown, mounted therein. The heater block 79 in the second embodiment 78 has a bore 93 coaxial with the axis 16 of the storage chamber 25, which bore 93 directly connects with the block's discharge bore 18, instead of interconnecting with that bore 18 through a connector bore 21 as in the case of the FIG. 2 embodiment. The heater block 79 in this second hand gun 78 embodiment is formed integral with a tubular casing 94 that extends rearwardly of the heater body 79 relative to the gun's nozzle 30. The tubular casing 94 defines the molten hot melt adhesive storage chamber 25 for this hand gun embodiment. The tubular casing 94 is closed at its rearmost end by an end cap 95 threadedly engaged, as at 96, with the tubular casing.

The pressurizing device 92 of this hand gun 90 includes a cup-shaped piston 97 located within the tubular casing 94, that piston being illustrated in the fully retracted attitude in solid lines in FIG. 3 and in the fully extended attitude in phantom lines in FIG. 3. The pressure wall 98 of piston 97 abuts front end face 99 of chamber 25 when the chamber is empty. The piston 97 is spring loaded by a compression spring 64 that is seated against the piston's pressure wall 98 at one end and abuts against end cap 95 at the other end. The pressure generated by piston 97 against the molten adhesive within the storage chamber 25 is, of course, caused by spring 64 pressure.

In use, the storage chamber 25 is first fully charged with molten hot melt adhesive through charge valve 80 so that the piston 97 is fully retracted as illustrated in solid lines in FIG. 3 (the rear face 103 of the piston abutting against the interior face of end cap 95 to define that rearmost or fully retracted position). During charging through charge valve 80, the charging pressure of the molten adhesive must be sufficient to overcome spring 64 pressure so as to cause piston 97 to retract from the phantom line to solid line position. Thereafter, and when the trigger 47 is activated by an operator, operation of the discharge valve 34 is as previously described in connection with the first embodiment. In this connection, pressure exerted on the molten adhesive within the storage chamber 25 by piston 97 forces the molten hot melt adhesive out through the gun's nozzle 30.

Figure 4:
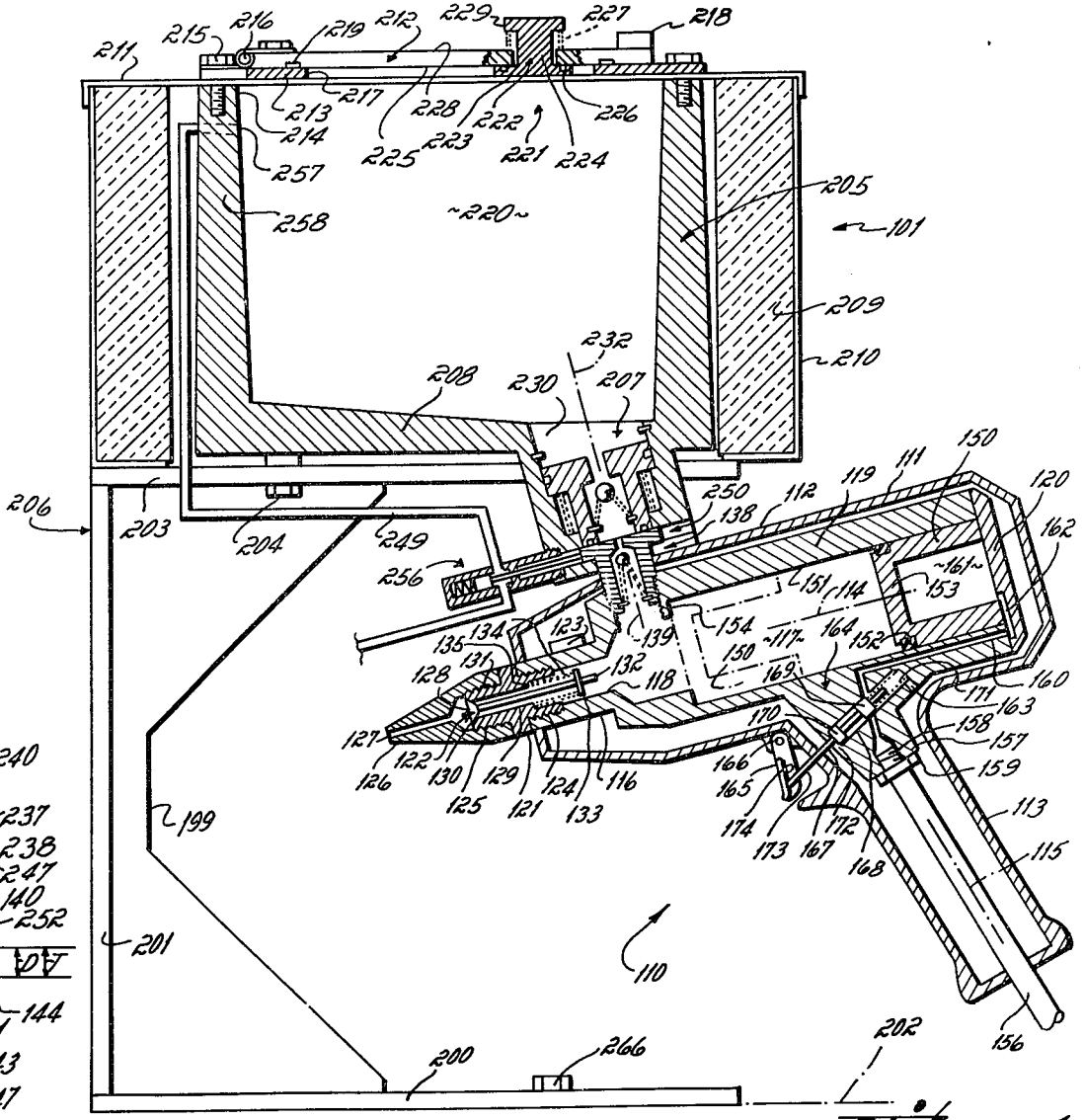
FIG. 4 is a cross-sectional view of a first embodiment of a molten adhesive source in accord with the principles of this invention, that molten adhesive source being shown in operative combination with a cross-sectional view taken along the center longitudinal plane of a third embodiment of a hand gun also structured in accord with the principles of this invention.
Figure 4A:
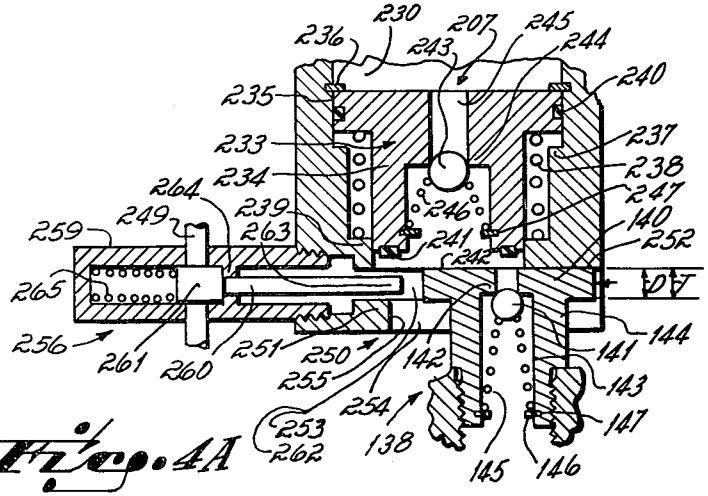
FIG. 4A is an enlarged view of the feed valve/charge valve structure illustrated in FIG. 4.

A third embodiment 110 of a hand held gun fabricated in accord with the principles of this invention is illustrated in FIGS. 4 and 4A. As shown in FIG. 4, the third embodiment 110 includes a housing 111 having a barrel 112 portion and a handle 113 portion, the barrel portion defining longitudinal axis 114 and the handle portion defining longitudinal axis 115, those axes interconnecting at an acute angle as illustrated. The housing 111 incorporates the barrel 112 portion and the handle 113 portion as a single integral part. This embodiment 110, as is apparent from FIG. 4, therefore presents a housing more in the nature of a classic pistol configuration. A one-piece heater block 116 and storage chamber 117 structure, of a generally tubular geometry, is mounted within the housing 111 coaxially with the longitudinal axis 114 of the gun's barrel 112 portion. This one-piece structure incorporates the heater body 116 with longitudinal discharge bore 118, and the storage chamber 117 as defined by longitudinal casing 119, that chamber opening directly into discharge bore 118 at one end and being closed at the other end by end cap 120. The heater body 116 and storage chamber 117 element is also provided with cartridge heaters, not shown, for maintaining a desired temperature level of that element 116, 119 so as to keep the molten adhesive within the storage chamber in a molten state after same has been charged into the gun from a separate molten adhesive source 101. The cartridge heaters are electrically connected with a thermostat 123 also mounted to that element 116, 119 for the purpose of sensing the temperature thereof, the cartridge heaters and thermostat being also electrically connected with an electric power source in a manner well known to those skilled in the art.

The gun's discharge valve 122 is located in discharge bore 118 of the heater body 116, a cross fitting 121 which forms the valve body of discharge valve 122, being threadedly received at one end as at 124 within the other end of discharge bore 118. The other end of the cross fitting 121 is threadedly received as at 125 in the gun's nozzle 126, that nozzle defining nozzle bore 127. A plunger shaped valve element 128 is coaxially received within the valve body's bore 129 as defined by the cross fitting 121. The valve element 128 includes head 130 adapted to seat against valve seat 131 defined at the forward face of the cross fitting 121. The stem 132 of the valve element 128 is provided with a flange 133 at that end opposite the head 130 end. A compression spring 134 is interposed between the forward face of that flange 133 and ledge 135 defined on the interior surface of bore 129 so as to continuously bias the valve's head 130 toward the closed attitude as illustrated in FIG. 4. Since the valve's head 130 is spring loaded closed, any pressure on the inner face of the valve's head exceeding the compression spring 134 pressure will cause the valve to open, thereby permitting discharge of molten adhesive from the gun's storage chamber 117 through the nozzle 126 onto a workpiece as desired.

The charge valve 138 in the hand gun 110 is generally similar to the charge valve 80 in the FIGS. 2 and 3 embodiment except that the charge valve axis 139 is normal to the axis 114 of the storage chamber 117. Further, the charge valve's adapter 140 is not dovetailed, i.e., is simply a flat, plate-shaped flange. As in the FIGS. 2 and 3 embodiments, 10 and 78, the charge valve 138 of the FIG. 4 embodiment 110 incorporates a ball 141 valve element adapted to seat against valve seat 142 defined in bore 143 of the valve body 144. The ball 141 valve element is spring 145 loaded against that seat 142, the spring being trapped by retainer ring 146 seated in groove 147 on the interior face of the valve bore 143.

The pressurizing device for the hand gun 110 is an air powered piston 150, the piston being cup-shaped in configuration. The piston 150 is slidingly received within the cylindrical bore 151 that constitutes storage chamber 117. An O-ring 152 is interposed about the periphery of the piston adjacent the pressure face 153 thereof so as to maintain a fluid tight seal between the piston and the storage chamber's wall 151. The piston 150 is retained within the storage chamber 117 by abutment against end cap 120 at one end (see solid line position in FIG. 4), and abutment against ledge 154 of the chamber at the other end (see phantom line position in FIG. 4).

The piston 150 is powered by pressurized air from a compressed air source, not shown, which is interconnected with the hand gun 110 through compressed air feed hose 156. As illustrated in FIG. 4, the compressed air hose 156 interconnects with toe 157 formed integral with the heater block 116 and storage chamber casing 119, a threaded fitting 158 and nut 159 being provided for that purpose. Air bore 160 connects the compressed air feed hose 156 with the interior 161 of the cup-shaped piston 150, that bore including a section 162 milled out in the end cap 120 which permits air to be continuously fed from that section 163 of the bore within the one-piece body 116, 119 continuously into the interior of the piston even when the piston abuts end cap 120.

A control valve 164 is interposed within that air bore 160, the control valve being connected with trigger 165 of the hand gun 110 so as to permit controlled operation of the gun by an operator as desired. The gun's trigger 165 is pivotally mounted by pin 166 to handle 113 of the gun. The control valve 164 includes stem 167 coaxially disposed in valve bore 168, the stem including a valve element 169 and a stop element 170. The stem 167 is spring 171 loaded into that attitude illustrated in FIG. 4; in that attitude the compressed air source is shut off from the piston 150 to establish the nonoperative attitude. The valve element 169 is positioned and maintained in this nonoperative or off attitude by stop 170 being seated against ledge 172 defined in the valve bore 168. The exterior end 173 of the valve stem is simply slidingly contacted with surface 174 of the gun's trigger 165.

In use, the third embodiment 110 of the hand gun is charged with molten hot melt adhesive from a separate molten adhesive source 101 with the control valve 164 structure in the nonuse or off attitude illustrated in FIG. 4. As is particularly apparent from that Figure, the piston 150, which is disposed in the phantom line attitude after all molten adhesive within the storage chamber 117 has been exhausted, is returned to the solid line attitude as molten adhesive is recharged into the storage chamber. Any air trapped within the storage chamber 117 to the rear of the piston 150, i.e., within space 161, is exhausted back through the groove 162 and bore 160 into the valve bore 168 behind the valve element 169 and out through exhaust port 163. In other words, exhaust port 163 permits the piston 150 to move rearwardly, as illustrated in FIG. 4, back into the solid line or completely charged attitude with little resistance as any air trapped within the storage chamber 117 exhausts through the exhaust port. When use of the gun 110 by an operator is desired, the trigger 165 is simply pulled, thereby moving the control valve element 169 to the right as illustrated in FIG. 4 to admit compressed air into bore 160 and groove 162 behind piston 150. The pressure thereby generated on the molten adhesive within chamber 117 by the piston 150 overcomes the pressure of compression spring 134. This forces the valve element 130 off valve seat 131 and permits molten adhesive to exhaust through the gun's nozzle 126. When discharge of molten adhesive is to be stopped, the trigger 165 is simply released with the result that valve spring 134 closes the discharge valve 122. This opens the space 162 in storage chamber 117, i.e., the space behind the piston 150, to atmosphere through the exhaust port 163, thereby eliminating high pressure on the molten adhesive within the storage chamber 117. This, in turn, permits the discharge valve's compression spring 134 to close the discharge valve 122, thereby stopping discharge of molten adhesive through the nozzle 126.

The Molten Adhesive Source

A first embodiment 101 of the molten adhesive source adapted for use with the hand gun 110 illustrated in FIGS. 4, 4*a* is illustrated generally in FIG. 1 and in detail in FIG. 4. As shown in FIG. 1, the hot melt source 101 includes a molten adhesive vessel 205 positioned on top of a stand 206. The vessel 205 itself is provided with a feed valve 207 in the floor 208 thereof, the feed valve being provided with structure, as described in detail below, which permits periodic and temporary interconnection of the hand gun 110 therewith. The pressure vessel is surrounded by insulation walls 209, those insulation walls being protected from the environment by a sheet metal casing having side walls 210 as well as a cover wall 211.

The molten adhesive vessel 205 is closed at the top by a lid 212 structure. It is, of course, through opening of the lid 212 that the vessel 205 may be charged with large quantities of hot melt adhesive for purposes of maintaining a ready supply of molten adhesive to the hand gun 110. The lid 212 structure comprises a frame 213 connected to the top edge 214 of the vessel 205 by bolts 215. The frame 213 supports the lid 212, and the lid is pivotally mounted on axis 216 on the frame for opening and closing the vessel 205 to atmosphere through access opening 217. The lid 212 includes a catch 218 at one end thereof, the catch being adapted to interconnect with the frame 213 for maintaining the lid in a closed attitude. The lid 212 also includes an O-ring 219 on the underside for sealing the lid to the frame 213, thereby maintaining the pressurized integrity of the vessel's interior 220. A manually operable pressure relief valve 221 is also provided in the lid 212. The pressure relief valve 221 comprises a valve element 222 with a valve head 223 on the bottom of a stem 224, the valve head being seated against the underside 225 of the lid with a seal being maintained through use of an O-ring 226. The valve head 223 is spring loaded into sealed relation with the underside of the lid by compression spring 227 interposed between the top side 228 of the lid and flange 229 at the top of the valve stem 224.

A feed valve 207, as previously mentioned, is incorporated into the floor 208 of the source vessel 205. The feed valve 207 includes a bore or tubular slideway formed integral with the vessel itself, that slideway defining a bore 230 having a longitudinal axis 232. The tubular slideway 230 carries the feed valve 207 in slideable or reciprocable relation therein. The feed valve 207 includes valve body 233 of generally T-shaped cross section, that valve body 233 being comprised of tubular section 234 and flange 235 at one end thereof. The valve body 233 and, hence, the valve 207, is slideable within the tubular slideway 230 between an inner limit defined by ring 236 received in an annular groove on the interior surface of the slideway 230, and seat 237 also defined on the interior surface of the slideway 230. In other words, and when in the fully closed attitude as shown in FIG. 4*a*, the valve body 233 is seated against the ring 236, the valve body being continuously biased into that position by compression spring 238 interposed between that valve body's flange 235 and ledge 239 defined in the slideway 230. When in the active or flow attitude, as illustrated in FIG. 4, the travel limit of valve body 233 is defined by seat 237. A first O-ring 240 is received in the periphery of the valve body's flange 235 to maintain a sealing relation between the interior 220 of the vessel 205 and atmosphere. A second O-ring 241 is carried in the outer face of the valve body's tubular section 234 for cooperation with the exterior face 242 of each hand gun's adapter 140 as described herinafter in detail.

The feed valve 207, in addition to valve body 233, also includes a ball 243 valve element adapted to seat on seat 244 defined in bore 245 through that valve body 233. The ball 243 valve is spring loaded toward the valve closed or seated attitude, as illustrated in FIG. 4A, by compression spring 246. The compression spring 246 is retained in loaded relation with the ball 243 valve by ring 247 carried in a groove defined on the interior surface of the valve bore 245. Thus, and as illustrated in FIG. 4A, with the feed valve 207 in the non-active attitude, the ball 243 valve is spring 246 loaded closed against seat 244 of the valve body 233, and the valve body 233 is spring 238 loaded against ring 236 of the slideway 230.

A gun coupling 250 is formed integral with the exterior end of slideway 230, the coupling serving to interconnect the hand gun 110 with the vessel 205 when charging or recharging of the gun with molten adhesive is desired. The coupling 250 is in the nature of a flat plate 251 spaced from end wall 252 of the slideway 230, and connected to the slideway by side walls 253. The flat plate 251 defines a slot or guideway 254 therein, that slot being of a width adapted to receive the body 144 of each gun's charge valve 138 in sliding relation therewith. The coupler plate 251 is spaced from the planar end face 252 of the slideway 230 a distance D equal to the thickness T of the adapter 140 plate carried by the hand gun 110. End 255 of the slot or guideway 254 in the coupler plate 251 serves to locate the gun's charge valve 138 in coaxial relation with longitudinal axis 232 of the source's feed valve 207 when the charge valve's body 144 is seated thereagainst, see FIG. 4.

The molten adhesive 205 vessel, combined with a hand gun 110, is pressurized by compressed air through structure illustrated in FIGS. 4 and 4*a*. When no hand gun 110 is being charged from the vessel 205, the pressure is relieved from that vessel by use of the manual pressure relief valve 221. The vessel 205 is interconnected with a compressed air source, not shown, through pressure line 249. A control valve 256 is interposed in the compressed air line 249, and is adapted to be activated by each hand gun's adapter 140 (as mounted to each hand gun's charge valve 138) when that adapter is fully seated within the feed valve's coupling 250. The control valve 256 is mounted on the slideway 230 in operative combination with the coupling 250 as illustrated in FIG. 4*a* particularly. The pressure line 249 exhausts into vessel 205 through port 257 adjacent the top edge of one of the vessel's side walls 258.

The control valve 256 for pressure line 249 includes a tubular body 259 threadedly received at the closed end of the coupling 250. The valve body 259 carries, in slideable relation therein, a stem 260 mounting a valve element 261 on one end thereof and extending into space or gap 262 between coupler plate 251 and the slideway's end face 252 at the other end 263 thereof. The stem 260 is maintained in alignment within the valve body by ribs 264. The air line 249 passes transversely through the tubular body 259 relative to stem 260. In the non-active or closed attitude, valve element 261 abuts rib 264 as so urged by compression spring 265, thereby closing off the vessel 205 from the compressed air source, i.e., thereby interrupting the compressed air line 249 at the control valve 256. The valve 261 is abutted against rib 264 in that closed attitude by spring 265 as to maintain the valve in the closed attitude at all times unless otherwise activated.

In use, and when the hand gun's adapter 140 is inserted into the coupling 250 so as to place the hand gun's charge valve 138 in coaxial longitudinal axis 232 relation with the vessel's feed valve 207, i.e., when the charge valve's body 144 is seated against bottom edge 255 of the slot 254 in coupler plate 251 as illustrated in FIG. 4, the charge valve's adapter 140 engages the control valve's stem end 263 to displace the valve element 261 from blocked relation with the compressed air line 249, thereby opening the vessel's interior 220 to the compressed air source as illustrated in FIG. 4*a*. This, in turn, permits the molten adhesive within vessel 205 to be pressurized, which pressure causes transfer of molten adhesive through the vessel's feed valve 207 and the gun's charge valve 138 into the hand gun's storage chamber 117. In other words, when the vessel 205 is pressurized that pressure overcomes the feed valve's compression spring 238 pressure to force the valve body 233 into O-ring 241 sealing relation with the gun's adapters's face 242, and also forces the ball 243 valve off seat 244 in the valve body 233 to permit molten adhesive to flow through the feed valve 207 as described more fully below.

The molten adhesive vessel 205 of the first embodiment 101 is mounted on stand 206 by bolts 204. The floor 203 of the stand 206 is elevated substantially above a table top 202 or other surface on which the vessel 205 is supported, by vertical post 201 connected to foot 200 of the stand. The floor 203 of the stand 206 is maintained parallel to the foot 200 of the stand by a gusset 199 interposed therebetween and mounted to the side post 201. The stand's foot 200 may be bolted, as at 266, to, for example, a table top or the like. The elevation of the vessel's floor 208 above the stand's foot 200 permits ready interengagement of the hand gun's charge valve 138 with the vessel's feed valve 207 as illustrated in FIGS. 1 and 4.

The second embodiment 100 of a hot melt source particularly adapted for use in combination with the hand gun structures of this invention is illustrated in U.S. Pat. No. 3,827,603, issued Aug. 6, 1974, and assigned to the assignee of this application. This patent illustrates a pump and molten adhesive reservoir system that can be particularly adapted for use in connection with the system of this invention. The pump is electrically controlled by an on/off switch to regulate flow of molten adhesive from the reservoir of the structure illustrated in that patent. One of the primary differences between this second embodiment 100 of a molten adhesive source and the first embodiment 101 described above is that the first embodiment is automatically activated when the hand gun 110 is fully seated or located in operative combination with feed valve 207. But the molten adhesive source 100 of the second embodiment must be manually activated by operating an on/off switch once a hand gun 10 or 78 is operationally connected with the charge valve 270 of the second embodiment.

The reservoir and pump structure shown in U.S. Pat. No. 3,827,603, as is illustrated diagrammatically at 100 in FIG. 5 of this application, is used with a novel feed valve 270 structure as illustrated in FIG. 6 of this application. As shown therein, a slideway block 271 is mounted to the source's manifold block 272 by bolts 273, that block 271 defining an outer valve bore 274 and seat 269 for O-ring 268. The valve bore 274 is coaxially disposed with longitudinal axis 275 of feed bore 276 in the manifold block 272. The feed valve 270 includes a primary valve element 277 having an inner valve bore 278 therein, the primary valve element being slidably received in outer valve bore 274 defined in the slideway block 271. Flange 279 of the primary valve element 277 seats an O-ring 280 about the periphery thereof for purposes of maintaining a sealing relation between the primary valve element and the slideway block 271. The primary valve element 277 also defines a valve seat 281 for a valve head 282. The primary valve element 277 is movable within bore 274 between a non-active or closed attitude illustrated in solid lines in FIG. 6, and a fully open or charge attitude (not shown) in which end face 283 abuts seat 284 defined in the valve bore 274. The primary valve element 277 is continuously spring loaded by compression spring 285 toward that attitude illustrated in sold lines in FIG. 6, the compression spring being seated at one end on the seat 284 of the valve bore 274 and at the other end against the underside of the primary valve element's flange 279.

A secondary valve element 286 is slidably received within inner or center bore 278 of the primary valve element 277, the secondary valve element including a valve stem 287 that threadedly mounts the valve head 282 at one end thereof. A sealing relation is maintained between primary 277 and secondary 286 valve elements by O-ring 288 on the exterior periphery on the secondary valve element's stem 287. An inner bore 289 in the secondary valve element 286 interconnects with the inner bore 278 defined by the primary valve element 277 through cross bore 290 in the secondary valve element. The secondary valve element 286 also includes an annular flange 291 at that end opposite the valve head 282, the annular flange being seatable against seat 292 defined in the valve bore 274 to define the closed or non-operative position of the feed valve 270 illustrated in solid lines in FIG. 6. An O-ring 293 is received on the exterior face 294 of the secondary valve element 286 for cooperation with the exterior face 295 of a hand gun's adapter 84 (see FIGS. 2 and 3) as described in detail below. Note particularly, as illustrated in FIG. 6, that when in the non-operative or closed attitude the exterior face 294 of the secondary valve element 286 is withdrawn or recessed behind the exterior face 296 of the slideway block 271. Flow of molten adhesive from the reservoir 100 out through the feed valve 270 is through feed bore 276 into the valve bore 274, then into inner bore 278 through the gap between valve head 282 and seat 281, then into inner bore 289 through cross bore 290, and then to discharge.

A coupling 301 in the form of a coupler plate 302 is mounted to the exterior face 296 of the slideway block 271 by the same bolts 273 that mount that block 271 to the hot melt unit's manifold block 272. The coupler plate 302 defines a slot 303 therein analogous to slot 254 in the coupler plate 251 illustrated in FIGS. 4 and 4*a*. The slot 303 is of a width W equal to the diameter D of the charge valve's body 81 on that gun 10 or 90 with which same is adapted for use. The coupler plate 302 also defines a dovetailed passageway 304 therein, the slot 303 and passageway 304 being symmetrically disposed relative to the longitudinal axis 275 of the feed valve 270. Bottom edge 305 of the slot 303 cooperates with the exterior surface of charge valve's body 81 on both gun 10 and 90 to stop and locate that gun's charge valve 80 in coaxial relation with feed valve axis 275. The dovetailed passageway 304 is adapted to be used, of course, only with a dovetailed adapter 84 as shown on charge valve 80 of the guns 10 or 90 illustrated in FIGS. 2 and 3. A vent port 306 interconnects the bottom of the passageway 304 with atmosphere.

In use, and when the pump and reservoir 100 is activated by use of an on/off switch, not shown, pressurized molten adhesive is introduced into the valve body's bore 274 which forces the primary valve element 277 against seat 284, and which forces the secondary valve element 286 into sealing relation with the face 295 of the adapter 84 on a hand gun's charging valve 80 when the gun is operationally connected to the feed valve 270 by coupler 301. The difference in travel path length between primary 277 and secondary 286 valve elements causes the valve head 282 to lift off seat 281 on the primary valve element 277, thereby permitting molten adhesive to flow into the secondary valve element's bore 289 and, thence, open ball 88 valve in the gun's charge valve 80 for introduction into the hand gun's storage chamber 25 as described in greater detail below.

HOT MELT ADHESIVE DISPENSING SYSTEM

The hot melt adhesive dispensing system of this invention includes the hand held adhesive gun 10 or 90 or 110 and the separate molten adhesive source 100 or 101. As illustrated in each of the three embodiments of the hand held adhesive gun, each includes a charge valve 90, 138 disposed downstream of the gun's nozzle 30, 126, that charge valve being communicable with the gun's heater body 11, 116 and, thence, with the gun's storage chamber 25, 117. Each charge valve 80, 138 is of a one-way valve structure that, in effect, admits molten hot melt adhesive into the gun's storage chamber 25, 117 but prevents molten hot melt adhesive from exhausting through that valve structure, thereby limiting the discharge of molten adhesive from the gun's storage chamber through the gun's discharge valve 34, 122 as controlled by the gun's trigger 47, 165. Special connector or coupler structure 250, 301 is provided on each source 100, 101 that cooperates with special adapter structure 84, 140 on each gun 10, 90, 110 to interconnect each hand gun embodiment with each molten adhesive source for providing each gun with a charge of molten adhesive. Once that interconnection is achieved, and as the molten adhesive source 100, 101 is suitably pressurized, the feed valve structure 207, 270 associated with that source is activated so as to move a portion of that feed valve structure into sealing relation with the hand gun's charge valve structure 80, 138, thereby aiding in the prevention of leakage during transfer of molten adhesive from the source into the hand gun's storage chamber 25, 117. This system permits a single molten adhesive source 100, 101, i.e., a single supply source, to serve multiple hand guns 10, 90, 110, i.e., to serve a multiple number of operators. Further, the structural aspects of the system permit the hand gun 10, 90, 110 to be easily connected and disconnected from the source 100, 101 simply by sliding the gun into a limit stop type coupler structure 250, 301 adapted to receive the hand gun's charge valve's adapter 84, 140. The hand gun 10, 90, 110 structure itself is of light weight and is easy to manipulate.

Figure 5:
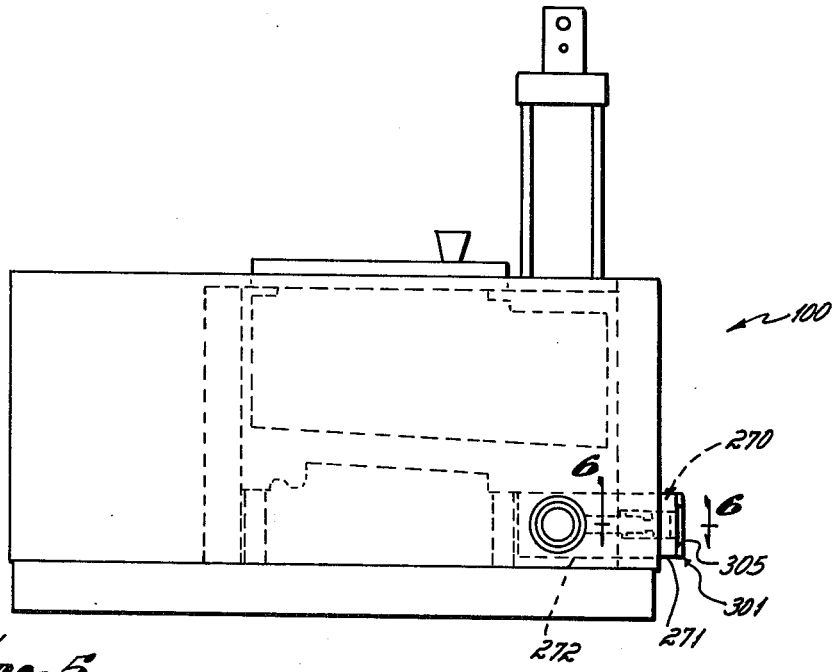
FIG. 5 is a side view of a second embodiment of a molten adhesive source in accord with the principles of this invention.
Figure 6:
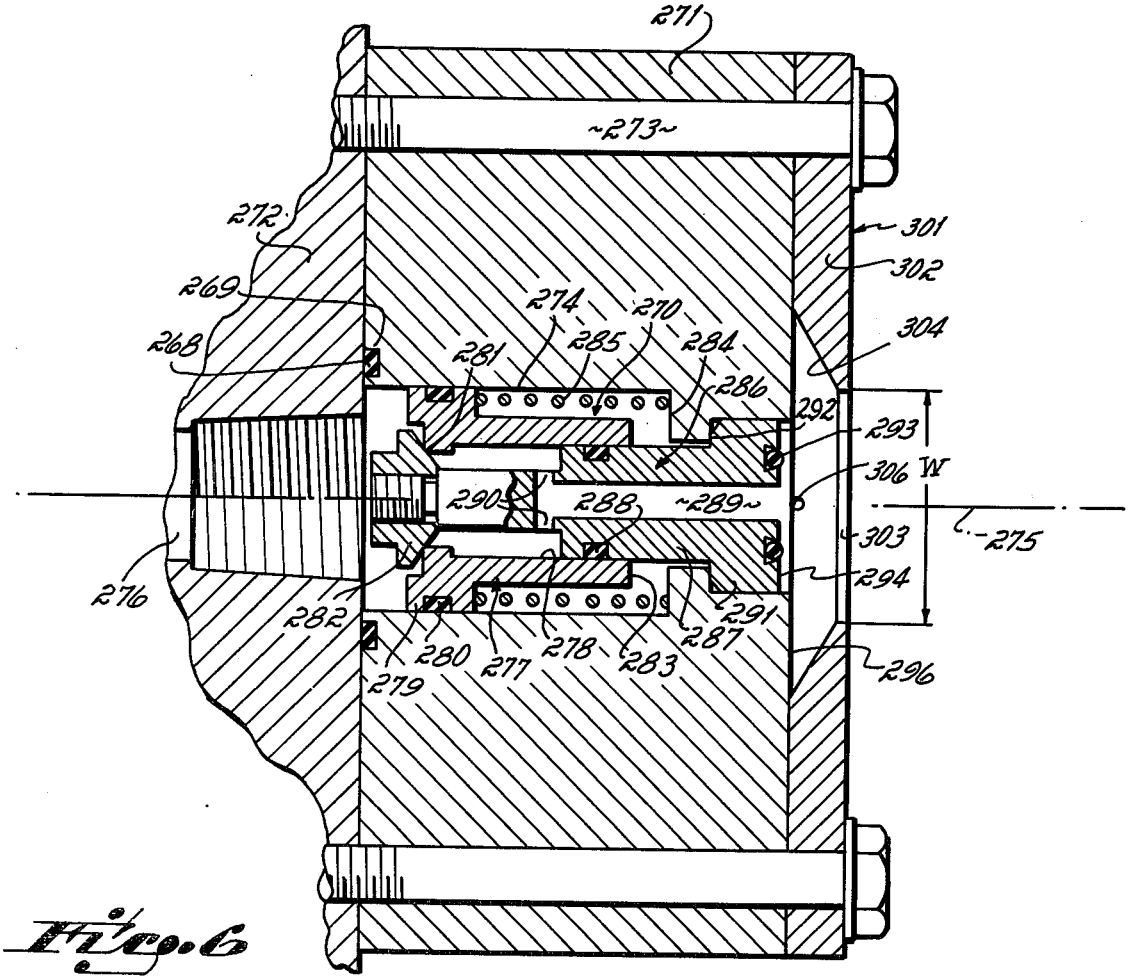
FIG. 6 is a cross-sectional view taken along line 6—6 of FIG. 5.

More particularly, and in use, the first embodiment 10 of the hand gun illustrated in FIG. 2 is adapted for use with the second embodiment 100 of the hot melt source illustrated in FIGS. 5 and 6. With the first embodiment gun's storage chamber 25 empty, the hand gun is gripped by the handle and oriented so that the charge valve's adapter plate 84 is inserted in passageway 304 defined by the source's coupler plate 302 until the charge valve's body 81 bottoms out or seats against bottom edge 305 of that plate's slot 303, thereby locating the charge valve's axis coaxially with the feed valve's axis 275 of the source 100. The passageway 304 is sized dimensionally, relative to the size of the gun's adapter plate 84, so that the plate is in sliding relation therewith but in a close tolerance fit therewith as well. Thereafter, the on/off switch of the source 100 is activated so that molten adhesive under pressure is fed through the manifold block's bore 276 into the valve body's bore 274 where the pressure of the adhesive initially overcomes compression spring 274 to force the primary valve element 277 against seat 284 in the valve bore 274. The pressure of the adhesive also causes the secondary valve element 286 to move toward the right as illustrated in FIG. 6 until O-ring 293 is disposed in sealing relation with the exterior face 295 of the gun's dovetailed adapter 84, thereby providing a closed or sealed flow path between the source's manifold block 272 and the gun's storage chamber 25. This relocation of the primary 277 and secondary 286 valve elements, in response to the pressurized molten adhesive, maintains the valve head 282 in spaced relation from the valve seat 281, thereby permitting molten adhesive to flow under pressure through the primary valve element's bore 278 into the secondary valve element's bore 289 against the ball 88 valve in the gun's charge valve 80. The pressurized molten adhesive also overcomes compression spring 89 pressure on the ball 88 valve, thereby permitting flow through the charge valve's bore 86 into the heater body's bore 18, 21, 20 and back into the storage chamber 25. As the gun's storage chamber 25 fills, the bladder 65 is collapsed until the chamber is totally filled. After the gun's storage chamber 25 has been filled, the source 100 is depressurized, and with the pressure released therefrom the source's feed valve 270 closes. Closure of the feed valve 270 is effected in response to compression spring 285 pressure forcing the primary valve element 277 to the left as illustrated in FIG. 6, thereby seating valve head 282 on seat 281. The primary element continues its leftward motion, drawing the secondary valve element 286 therewith until the secondary valve element is seated on seat 292. This removes O-ring 293 from sealing relation with the gun adapter's face 295, and thereby recesses the feed valve 270 into bore 274. Thereafter, the gun's adapter 84 is removed from the passageway 304 to disengage the gun 10 from the source 100, and is thereafter ready for use. Use of the hand gun 10 thereafter is as previously described.

The FIG. 3 embodiment 90 of the hand gun is likewise adapted for use with the molten adhesive source 100, illustrated in FIGS. 5 and 6, in the same manner as previously described for the FIG. 2 embodiment 10. Use of that hand gun embodiment, after the storage chamber 25 thereof is filled, has been previously described.

Use of the FIG. 4 hand gun embodiment 110 is illustrated in FIGS. 1, 4 and 4A. As shown therein, and when the storage chamber 117 with the gun 110 is empty, the gun is oriented so as to be introduced into the passageway defined between coupler plate 251 and end face 252 of the source's feed valve 207. That introduction is illustrated in FIG. 4A, and is fully accomplished when the valve body 144 seats against lower edge 255 of the slot 254 as illustrated in FIG. 4. In this attitude the gun's adapter 140 has activated control valve 256 by contact with the valve stem 260, thereby removing spring 265 loaded valve element 261 from the air pressure line 249. This opens the pressure line 249 to vessel 205, pressure on the molten adhesive therein forcing the source's valve body 233 away from the non-operative attitude illustrated in FIG. 4A toward the exposed face 242 of the gun's adapter 140 and into sealing relationship therewith illustrated in FIG. 4. This pressure on the molten adhesive also forces ball 243 valve off the seat 244 of the valve body 233 against compression spring 246 to permit flow of pressurized molten adhesive past the ball valve 243 against the gun's charge valve 138. The molten adhesive pressure against the gun's charge valve 138 lifts the ball 141 off its seat 142 as well, thereby permitting introduction of the molten adhesive into the heater body's bore 118 and thence into the storage chamber 117. This, of course, permits automatic filling of the gun's storage chamber 117 in response to coupling of the hand gun's charge valve 138 in coaxial relation with the source's feed valve 207. Once the gun 110 is filled, it is removed from the coupler 250, thereby automatically closing the compressed air line 249 to the vessel 205; pressure on the vessel is released by manual pressure release valve 221. Since no pressure is on the molten adhesive within the vessel 205 thereafter, compression spring 246 moves the ball 243 valve against seat 244, and spring 238 lifts valve body 233 away from the face 242 of the gun's adapter 140 to permit full removal thereof. Use of the gun 110, once recharged, is as previously described.

Having described in detail the preferred embodiments of our invention, what we desire to claim and protect by Letters Patent is:

1. A method of charging a hand held hot melt thermoplastic adhesive dispensing gun of the type adapted to discharge a molten fluid adhesive, that method comprising the steps of providing a storage chamber within said gun, providing a source of molten fluid adhesive at a location separate from said gun, periodically connecting a feed valve mounted to said source with a charge valve mounted to said gun, and pressurizing said fluid adhesive within said source to force a charging flow of adhesive from said source through said valves into said gun's storage chamber.

2. A method as set forth in claim 1, including the step of automatically opening said source's feed valve and said gun's charge valve in response to pressurization of said source.

3. A method as set forth in claim 1, including the step of connecting said source's feed valve and said gun's charge valve in a sealing relationship one with another in response to pressurization of said source.

4. A method as set forth in claim 1, including the step of automatically closing said gun's charge valve upon disconnection of said gun's charge valve from said source's feed valve.

5. A system for dispensing a molten fluid thermoplastic adhesive, said system including a hand held gun a molten fluid adhesive source located remote and separate from said gun, said gun comprising a storage chamber adapted to receive a charge of molten fluid adhesive therein, a charge valve structured to receive molten fluid adhesive therethrough from the exterior of said gun, and to prevent discharge of fluid adhesive therethrough from the interior of said gun, a nozzle through which the molten fluid adhesive is discharged, and a discharge valve actuable by an operator for controlling discharge of the molten fluid adhesive from said gun, and said fluid adhesive source comprising a feed valve mounted to said source, said feed valve being connectable with said gun's one-way charge valve to permit charging of said gun's storage chamber with a molten fluid adhesive charge from said molten fluid adhesive source and then subsequent disconnection of said gun's one-way charge valve from said source mounted feed valve.

6. A system as set forth in claim 5, said gun further comprising a pressurizing device at least partially carried within said storage chamber, said pressurizing device serving to pressurize the fluid adhesive within said storage chamber to force discharge of same through said nozzle in response to operation of said discharge valve.

7. A system as set forth in claim 5, said fluid adhesive source comprising a pressurizing device connected to said fluid adhesive source, said pressurizing device serving to pressurize the fluid adhesive retained within said source.

8. A system as set forth in claim 5, said gun's charge valve and said source's feed valve being cooperable to form a sealed bore therebetween.

9. A system as set forth in claim 8, at least one of said gun's charge valve and said source's feed valve including a movable element adapted to move into sealing relation with the other of said valves in response to pressure on the fluid adhesive within said source.

10. A system as set forth in claim 9, each of said gun's charge valve and said source's feed valve being normally spring loaded closed.

11. A hand held gun for dispensing a molten fluid adhesive, said gun comprising a storage chamber within which a charge of molten fluid adhesive is stored, a nozzle through which said molten fluid adhesive is discharged onto a workpiece, a discharge valve operable by the gun's operator for controlling discharge of the molten fluid adhesive through said nozzle, a pressurizing device within said gun, said pressurizing device maintaining that molten fluid adhesive within said storage chamber under pressure during discharge of fluid adhesive from said gun, a charge valve connected with said storage chamber, said charge valve permitting flow of a molten fluid adhesive charge one way through said valve into said storage chamber for charging and recharging said storage chamber, but preventing flow of fluid adhesive from said storage chamber out through said charge valve to atmosphere, and adapter means mounted on said gun, said adapter means being operable to sealingly connect said gun with a remote and separate fluid adhesive source for charging said storage chamber through said one-way charge valve and to permit said gun to be disconnected from said fluid adhesive source and used as a portable device.

12. A hand gun as set forth in claim 11, said pressurizing device being a fluid filled bladder.

13. A fluid adhesive source for charging and recharging molten fluid thermoplastic adhesive from that source into a separate hand held adhesive dispensing gun, said source comprising a vessel within which a supply of said molten fluid adhesive is stored, a feed valve mounted to said vessel, said feed valve being movable between sealing and non-sealing attitudes relative to an adhesive gun's feed valve in response to supply of the fluid adhesive to the feed valve of said gun, and coupler means connected to said source, said coupler means being operable to sealingly interconnect said hand gun's feed valve to said source's feed valve to permit said gun to be disconnected from said sources' feed valve and used remotely and separately from said source as a portable device.

14. A fluid adhesive source as set forth in claim 13 which further includes pressure means adapted to selectively pressurize the fluid adhesive within said vessel, said vessel feed valve being responsive to pressurization of the fluid adhesive within said vessel to move to a sealing attitude relative to said gun feed valve, and said pressure means comprising a pressurized fluid.

15. A fluid adhesive source as set forth in claim 13 said coupler means being structured to restrain said valves in connected position during charging of said gun.

16. A fluid adhesive source as set forth in claim 13 wherein said vessel feed valve comprises a valve body slidingly received in a slideway, said valve body being movable between an extended position and a retracted position in response to fluid pressure within said vessel, and to the lack of fluid pressure within said vessel, and a valve element adapted to seat in sealing relation with a bore in said valve body.

* * * * *